US006669602B1

(12) United States Patent
Tsai

(10) Patent No.: US 6,669,602 B1
(45) Date of Patent: Dec. 30, 2003

(54) HOCKEY TABLE COMBINED WITH EXERCISE MACHINES

(76) Inventor: Hung-Chin Tsai, No. 38, Yi-Wen St., Taiping City, Taichung Hsien (TW)

( * ) Notice: Subject to any disclaimer, the term of this patent is extended or adjusted under 35 U.S.C. 154(b) by 0 days.

(21) Appl. No.: 10/195,534

(22) Filed: Jul. 16, 2002

(51) Int. Cl.[7] ..... A63B 22/02; A63F 1/00
(52) U.S. Cl. ..... 482/54; 273/148 R
(58) Field of Search ..... 482/51–54, 57–65, 482/148; D21/385, 397; 273/118 R, 119 R, 126 A, 126 R, 148 R

(56) References Cited

U.S. PATENT DOCUMENTS 5,366,427 A * 11/1994 Price, II ..... 482/92
5,637,061 A * 6/1997 Price, II ..... 482/92
5,711,745 A * 1/1998 Yang ..... 482/54
D463,832 S * 10/2002 Zucchi et al. ..... D21/385

* cited by examiner

*Primary Examiner*—Stephen R. Crow
(74) *Attorney, Agent, or Firm*—Rosenberg, Klein & Lee

(57) ABSTRACT

A hockey table combined with exercise machines is disclosed. The hockey table has a court formed thereon. A plurality of apertures is defined in the court. A disc is placed on the court. Two exercise machines are respectively provided at two ends of the hockey table. Each of the exercise machines has a frame secured on the ground. A driving means is provided on the frame. A blower axle is formed at the front end of the frame and driven by the driving device. Two blowers are respectively mounted on the blower axles of the exercise machines. Two air conduits connect the respective blowers to the hockey table.

7 Claims, 6 Drawing Sheets

HOCKEY TABLE COMBINED WITH EXERCISE MACHINES

BACKGROUND OF THE INVENTION

1. Field of the Invention

The present invention is related to sports equipment, and more particularly to a hockey table combined with exercise machines.

2. Description of Related Art

Referring to FIG. 6, table hockey is a game that is played on a table (60) by two persons who hit a hard disc (62) over the court (61). In the conventional hockey table (60), a fan (not shown or numbered) is provided in the table (60) to slightly suspend the disc (62) above the surface of the table (60) for reducing friction between the table surface and the disc, whereby the disc (62) moves smoothly in a game.

The fan must be driven by a power supply, so that it is impossible to play the game in a situation without a power supply. Furthermore, it is also inconvenient to manufacture the hockey table because safety of using electric power and standards of voltages according to various countries must be considered by manufacturers.

Using exercise machines such as treadmills, gym bicycles to build bodies involves repeating simple but boring actions, which may cause an exerciser to tire of the sport soon.

Therefore, the invention provides a hockey table combined with exercise machines to mitigate and/or obviate the aforementioned problems.

SUMMARY OF THE INVENTION

The main objective of the invention is to provide sport equipment that combines a hockey table with exercise machines to give users a great interest in playing.

Other objects, advantages and novel features of the invention will become more apparent from the following detailed description when taken in conjunction with the accompanying drawings.

DETAILED DESCRIPTION OF THE PREFERRED EMBODIMENT

Figure 1:
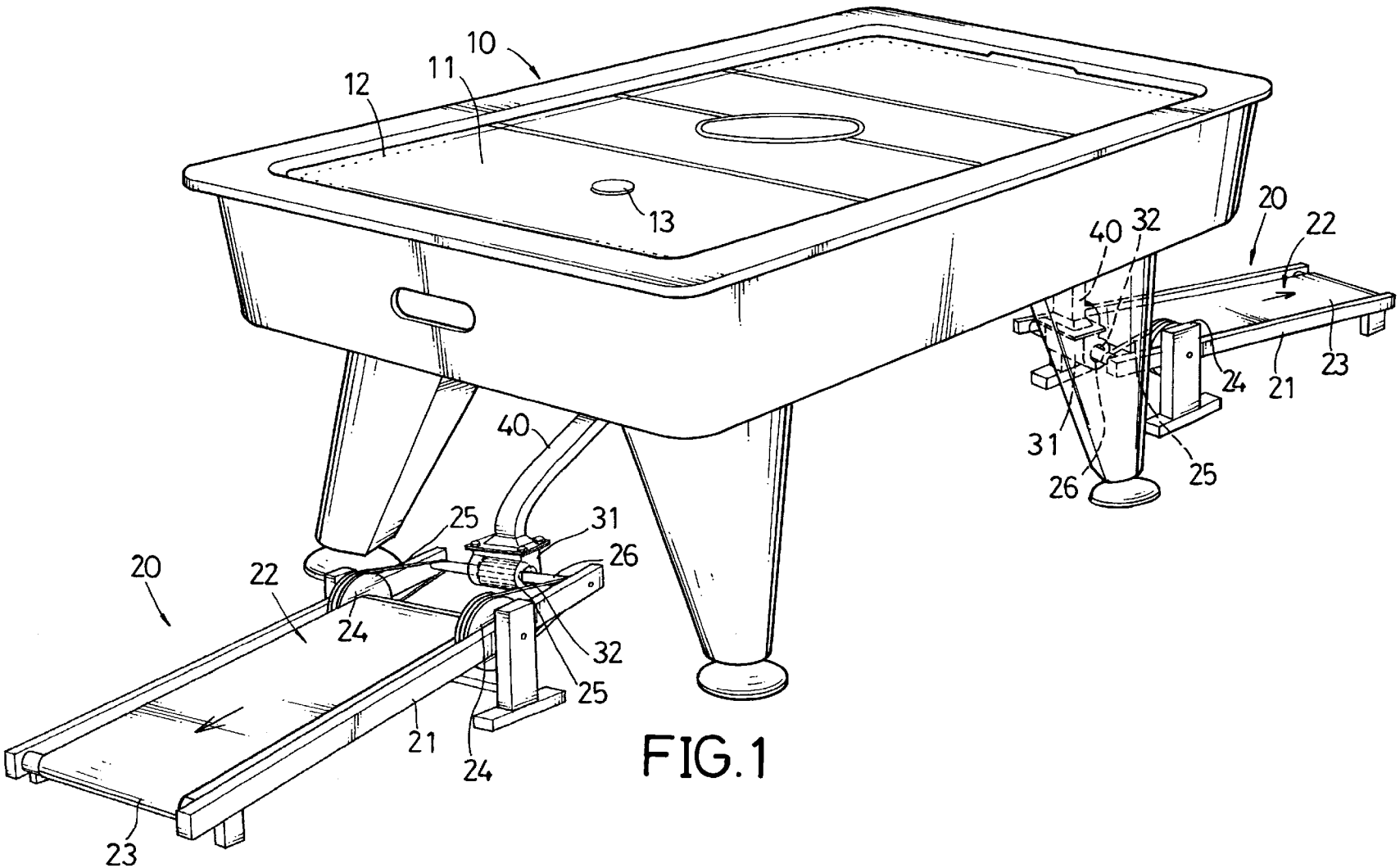
FIG. 1 is a perspective view of a hockey table combined with exercise machines in accordance with the invention.
Figure 2:
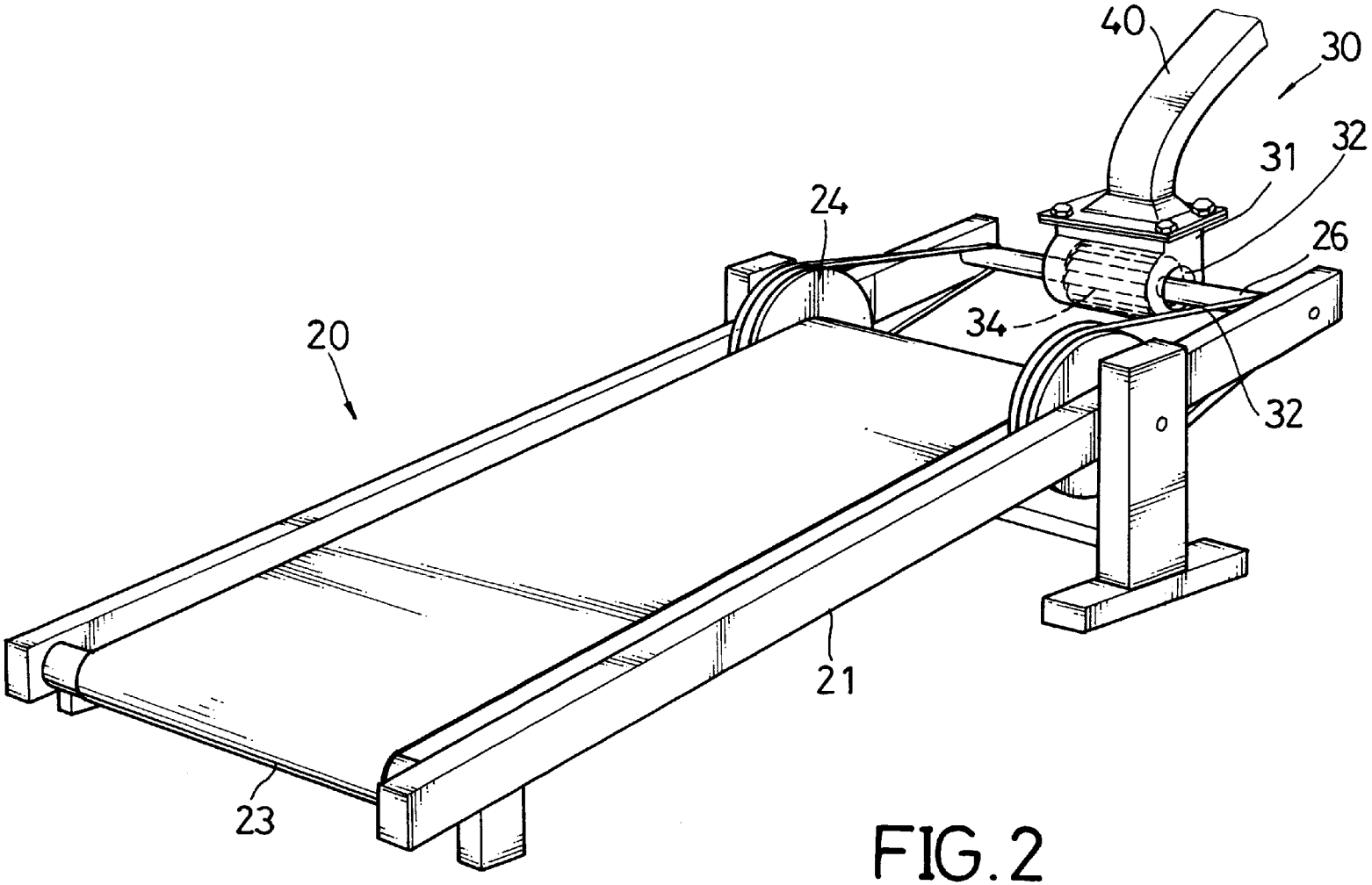
FIG. 2 is a perspective view of the exercise machine of the invention.
Figure 3:
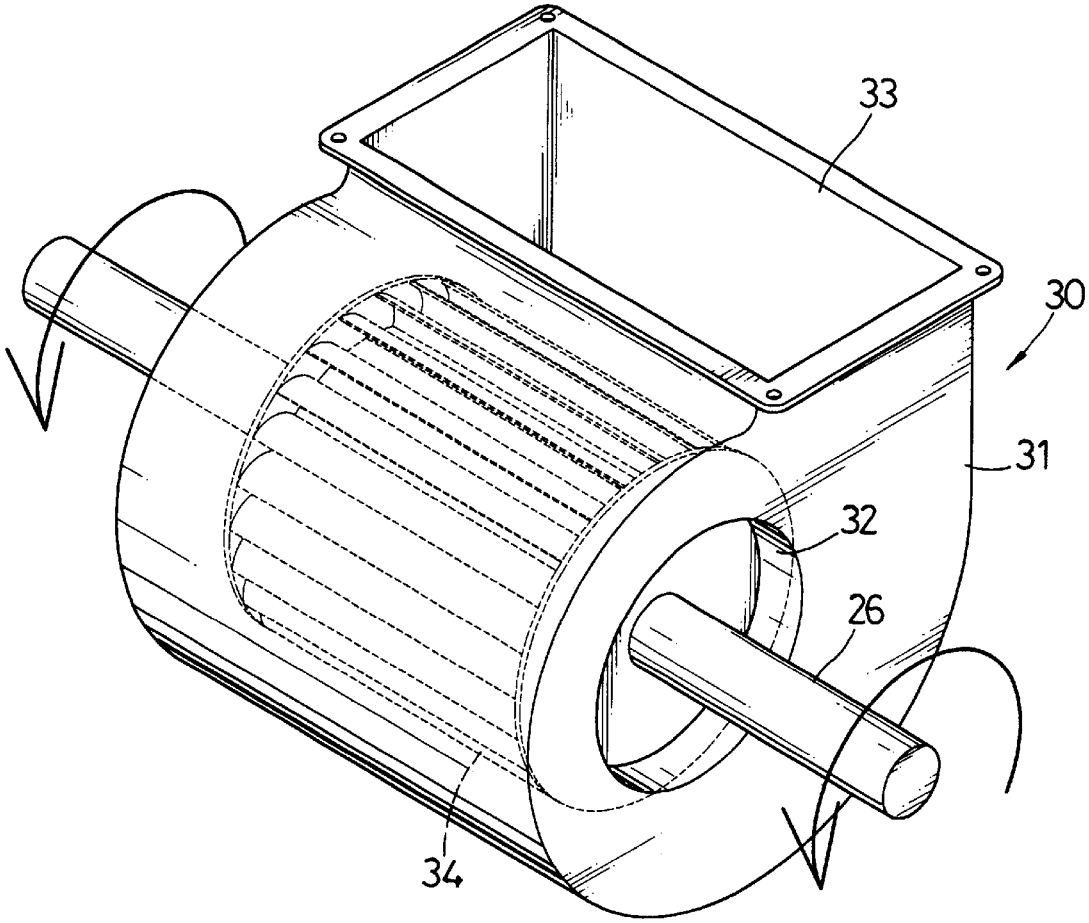
FIG. 3 is a perspective view of a blower attached to the exercise machine.

Referring to FIGS. 1–3, a hockey table (10) in accordance with the invention has two exercise machines (20) respectively attached to two ends thereof.

The hockey table (10) has a court (11) and a plurality of apertures (12) defined through the court (11). Air can be blown out from the apertures (12) to slightly suspend a disc (13) above the court.

In this embodiment, the exercise machine is a treadmill (20). It should be known by those skilled in the art that other exercise machines (20) such as gym bicycles also can be used in the invention.

The treadmill (20) has a frame (21) slantwise secured on the ground, and a driving means (22) provided in the frame (21). The driving device (22) includes a band (23) movably mounted on a front axle and a rear axle (neither numbered) on the frame (21), and a pair of pulleys (24) rotatably mounted at the front axle and driven by the band (22). A blower axle (26) is provided at a front end of the frame (21) and connected with the pulleys (24) by belts (25).

It should be known by those skilled in the art that the pulleys (24) and the belt (25) can be replaced with sprocket wheels and chains.

A blower (30) is mounted on the blower axle (26). The blower (30) has a housing (31) and an axial flow fan (34), which is driven by the blower axle (26), received in the housing (31). The housing (31) has two air inlets (32) defined at two sides thereof and an air outlet (33) defined at a top thereof.

An air conduit (40) is connected to the air outlet (33) with a first end thereof. A second end of the air conduit (40) is connected to an air inlet (not shown or numbered) of the hockey table (10).

Figure 4:
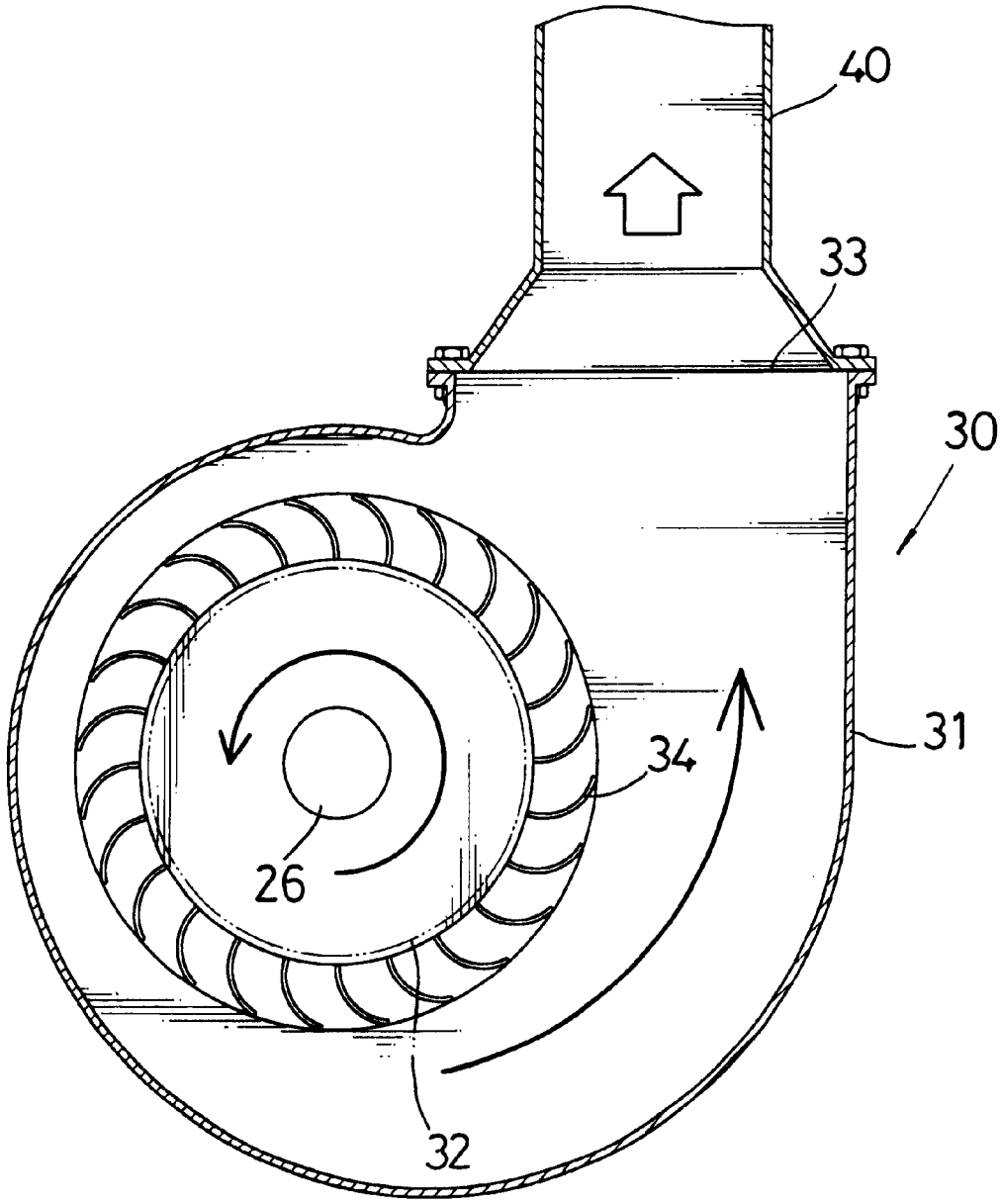
FIG. 4 is a sectional side view of the blower and an air conduit connected with the blower.
Figure 5:
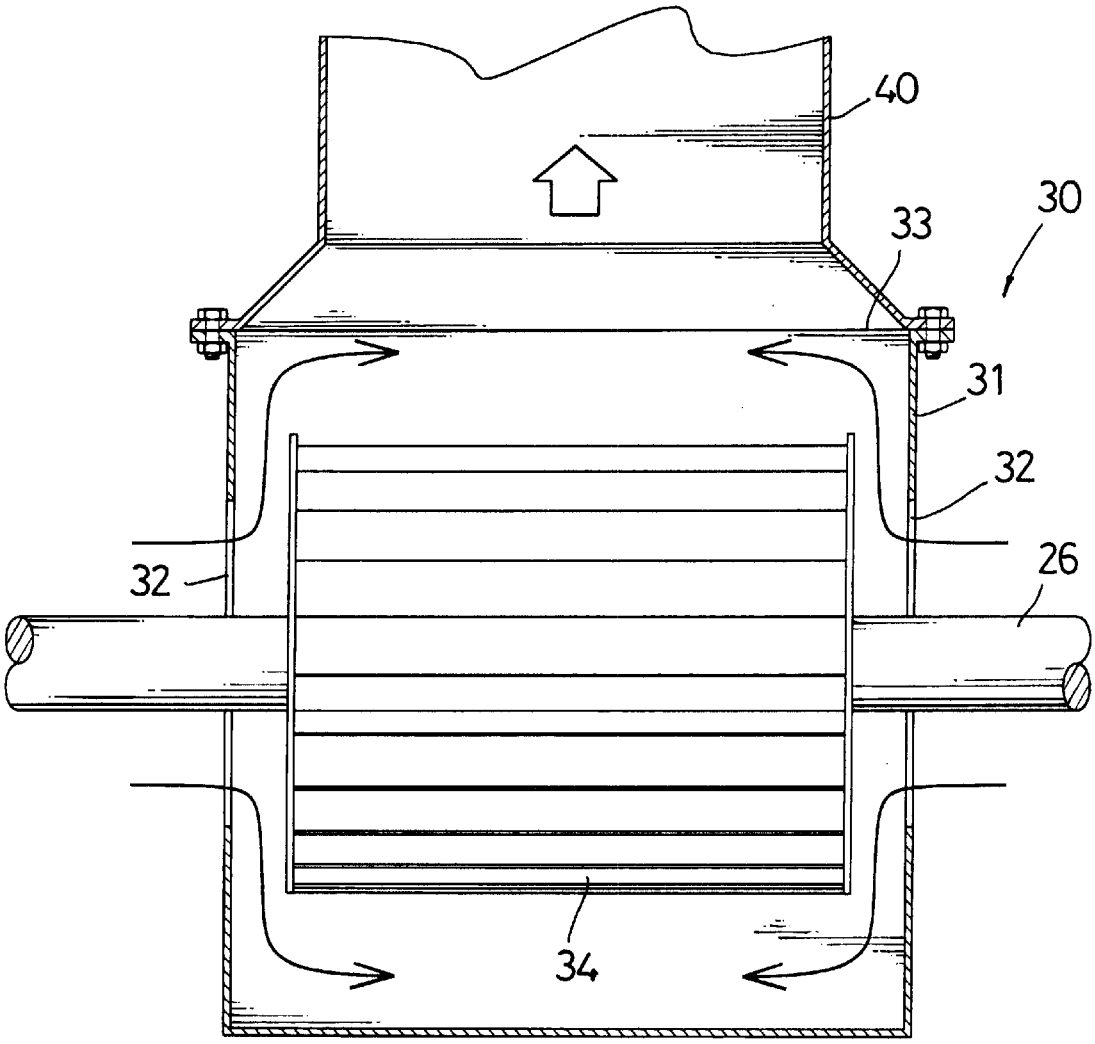
FIG. 5 is a sectional top view of the blower and the air conduit.
Figure 6:
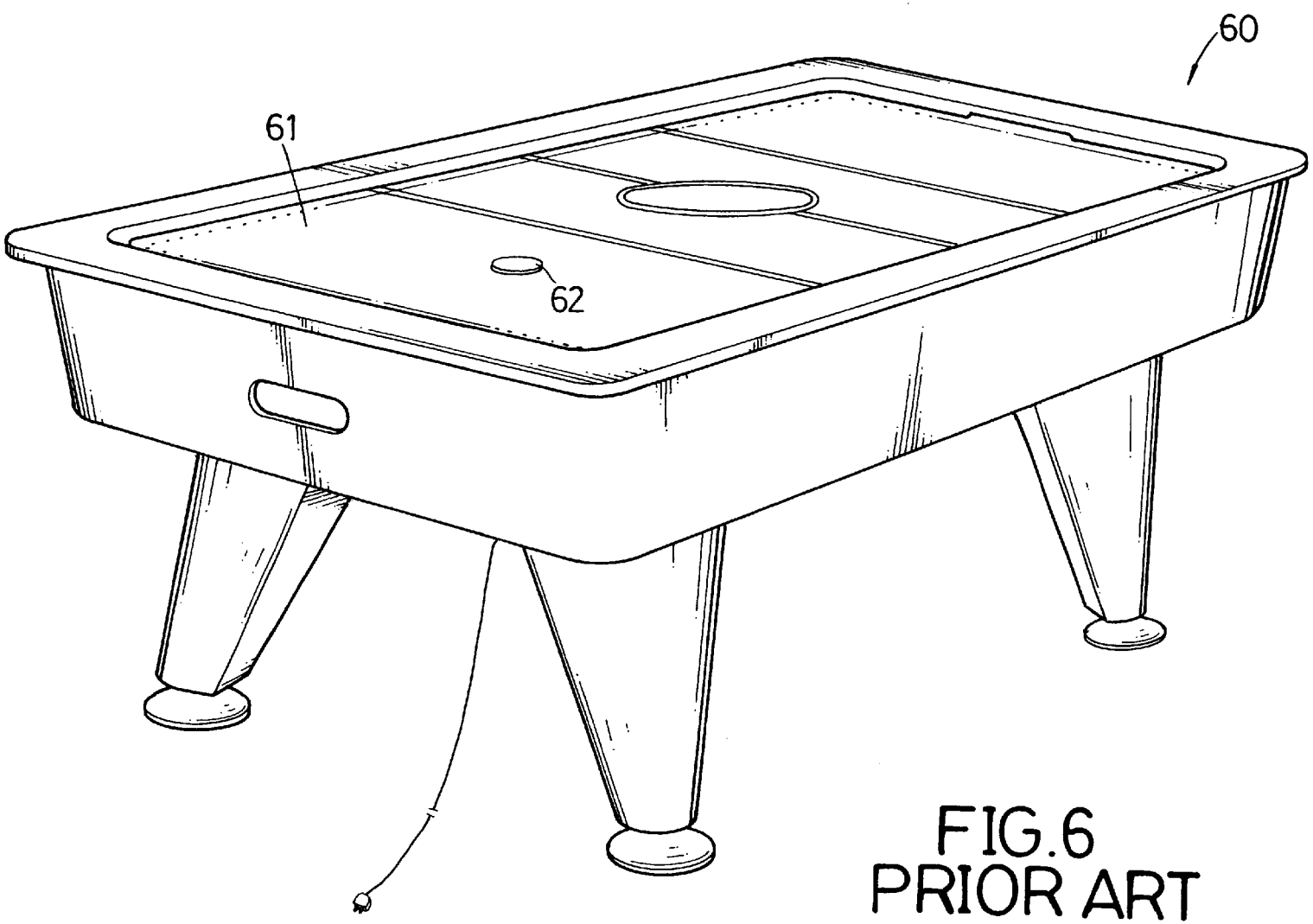
FIG.6 PRIOR ART
FIG. 6 is a perspective view of a conventional hockey table.

When a user runs on the treadmill (20), the band (23) is moved round to rotate the pulleys (24). The blower axle (26) then is driven by the belt (25) to rotate the fan (34). As illustrated in FIGS. 4 and 5, external air flows in the housing (30) through the air inlets (32) and out from the air outlet (33). The wind is blown out from the apertures (12) in the court (11) to push the disc (13) up, so that the user can play the table hockey with another user by hitting the disc (13).

Therefore, according to the present invention, by means of transforming mechanical power to wind power, the hockey table (10) does not need a power supply to drive the axial flow fan (34), and the disc (13) can be pushed up by the wind from the apertures (12). The users can play the table hockey while exercising body, which gives the users a great deal of interest.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A hockey table combined with exercise machines, comprising:

a hockey table (10) having a court (11) formed thereon, a plurality of apertures (12) defined in the court (11), and a disc (13) placed on the court (11);

at least one exercise machine (20) provided at a first end of the hockey table (10), the exercise machine (20) having a frame (21) secured on the ground, a driving means (22) provided on the frame (21), and a blower axle (26) formed at the front end. thereof and driven by the driving means (22);

at least one blower (30) mounted on the blower axle (26) of the at least one exercise machine (20); and at least one air conduit (40) connecting the blower (30) to the hockey table (10).

2. The hockey table combined with exercise machines as claimed in claim 1, wherein the exercise machine (20) is a treadmill, of which the driving means (22) comprises a band (23) movably mounted on a front band axle and a rear band axle on the frame (21), and a power transmitting means provided at the front band axle and connected to the blower axle (26).

3. The hockey table combined with exercise machines as claimed in claim 2, wherein the power transmitting means comprises a pair of pulleys (24) provided on the front band axle of the frame (21) and two belts (25) connecting the pulleys (24) and the blower axle (26).

4. The hockey table combined with exercise machines as claimed in claim 2, wherein the power transmitting means comprises a pair of first sprocket wheels provided on the front band axle of the frame (21), a pair of second sprocket wheels provided on the blower axle (26), and two chains respectively connecting the first sprocket wheels and the second sprocket wheels.

5. The hockey table combined with exercise machines as claimed in claim 1, wherein the blower (30) comprises a housing (31);

two air inlets (32) respectively defined at two sides of the housing (31), and the blower axle (26) extending in the housing (31) through the air inlets (32);

an axial flow fan (34) received in the housing (31) and driven by the blower axle (26); and an air outlet (33) defined at a top of the housing (31).

6. The hockey table combined with exercise machines as claimed in claim 5, wherein the conduit (40) is connected with the air outlet (33) of the blower (30).

7. The hockey table combined with exercise machines as claimed in claim 1, further comprising another exercise machine (20) provided at a second end of the hockey table (10);

another blower (30) mounted on the other exercise machine (20); and another air conduit (40) connecting the other blower (30) to the hockey table (10).

* * * * *